United States Patent [19]

Arena

[11] 4,443,202

[45] Apr. 17, 1984

[54] SURFACE PROPELLER MOUNTING ASSEMBLY FOR BOATS

[76] Inventor: Daniel J. Arena, 3334 St. Marys Rd., Lafayette, Calif. 94549

[21] Appl. No.: 268,493

[22] Filed: May 29, 1981

[51] Int. Cl.[3] ..... B63H 5/14

[52] U.S. Cl. ..... 440/51; 440/66

[58] Field of Search ..... 440/51, 66, 69, 71, 440/79

[56] References Cited

U.S. PATENT DOCUMENTS

| | | | |
|---|---|---|---|
| 2,076,603 | 4/1937 | Svendsen | 440/71 |
| 2,314,370 | 3/1943 | Rietzke | 440/79 |
| 3,742,895 | 7/1973 | Horiuchi | 440/60 |
| 4,031,846 | 6/1977 | Tone | 440/60 |
| 4,057,027 | 11/1977 | Foster | 440/69 |

FOREIGN PATENT DOCUMENTS

| | | | |
|---|---|---|---|
| 2033324 | 5/1980 | United Kingdom | 440/66 |

OTHER PUBLICATIONS

Du Cane, Peter; "Seventh Symposium on Naval Hydrodynamics Panel Discussion No. 9–Planing Craft", Vosper Limited, Aug. 1968.

"Rudder", May 1975, pp. 38–42 and 79–82.

"Boating", Dec. 1980, pp. 59–61, and 101.

*Primary Examiner*—Sherman D. Basinger

*Attorney, Agent, or Firm*—Limbach, Limbach & Sutton

[57] ABSTRACT

A unitary assembly (10) for mounting a surface propeller (52) on the transom (T) of a boat hull (H). The assembly comprises a plate (12) for attachment to the hull (H); a prop shaft support (16) fixed to the plate (12) for juxtaposition against the transom (T); and, a rudder support arm (20) fixed to the plate (12) and extending rearwardly therefrom above and in spaced relationship to the shaft support (16). As a result of its unitary construction, the assembly provides for ready attachment of a surface prop to a hull without major hull modification or the necessity of aligning separate shaft bearing supports and rudder elements. In its preferred embodiment, the assembly also includes a propeller hood supported by the arm and a spray deflector at the aft end of the hood.

14 Claims, 8 Drawing Figures

SURFACE PROPELLER MOUNTING ASSEMBLY FOR BOATS

BACKGROUND OF THE INVENTION

The present invention relates to surface prop drives for boats and, more particularly, is directed to a simplified mounting assembly for such drives.

Surface prop drives are well-known in the prior art. They typically employ a drive shaft which extends through the transom of the hull or is accommodated by some special hull configuration so that when the boat is planing the prop assumes a surface running condition approximately half submerged and half above water level. Such a drive is particularly advantageous with high speed boats because the prop support imposes little or no water drag. Prior efforts have had the disadvantage, however, that they have employed either special and very expensive hull configurations and/or special cantilevered prop shaft supports. These special constructions were necessary to provide adequate shaft support and direct water flow around the prop, particularly during start-up.

Because of the expensive nature of prior art surface drives, such drives have met with quite limited acceptance. They are found primarily in racing boats and high speed luxury craft. Another reason for their limited acceptance has been the very large rooster-tail spray which the drives create.

SUMMARY OF THE INVENTION

The present invention avoids the shortcomings of the prior art by providing a simple mounting assembly which may be attached to a conventional transom with no major modification to provide prop shaft support; rudder steering means; water ducting around the prop during start-up; and spray suppression during surface prop running.

The mounting assembly is of a unitary construction and comprises: a plate adapted to be fixedly secured to the transom of a boat; a prop shaft support carried by the plate to rotatably support a prop shaft extending through the transom; a rudder support carried by the plate and extending rearwardly therefrom; and a hood carried by and extending rearwardly from the plate in upwardly spaced relationship to the shaft support. The assembly employs no separate cantilevered shaft supports and, thus, there is no requirement to align such supports with other supports or the prop shaft.

A principal object of the invention is to provide an improved unitary mounting assembly for a surface prop drive which may be attached to the transom of a boat with no major hull modification and no requirement for separate cantilevered prop shaft supports.

Another object of the invention is to provide an assembly which is relatively inexpensive to manufacture and is of light weight, as compared to conventional drives.

Another object of the invention is to provide such an assembly which provides a water duct to guide water around the prop during start-up.

Another object of the invention is to provide such an assembly which accommodates a water-spray deflector, which deflctor may be selectively adjustable.

Another object of the invention is to provide such an assembly which may incorporate a skeg to protect the prop from damage.

A further object of the invention is to provide such an assembly which may be used in multiples to accommodate multiple shafts, or may be constructed with a multiple shaft capability to provide a single assembly which can accommodate multiple shafts.

Yet another object of the invention is to provide such an assembly which accommodates the prop shaft seals and avoids any critical alignment problems with respect to the placement of such seals.

Still another object of the invention is to provide such an assembly which may incorporate a step for use by water skiers and which shields such skiers from the prop.

Yet a further object of the invention is to provide such an assembly which may be easily and inexpensively repaired in the event of damage and which is highly resistant to damage resulting from use or exposure to the elements.

The foregoing and other objects will become more apparent when viewed in light of the accompanying drawings and following detailed description.

DESCRIPTION OF THE PREFERRED EMBODIMENTS

Figure 1:
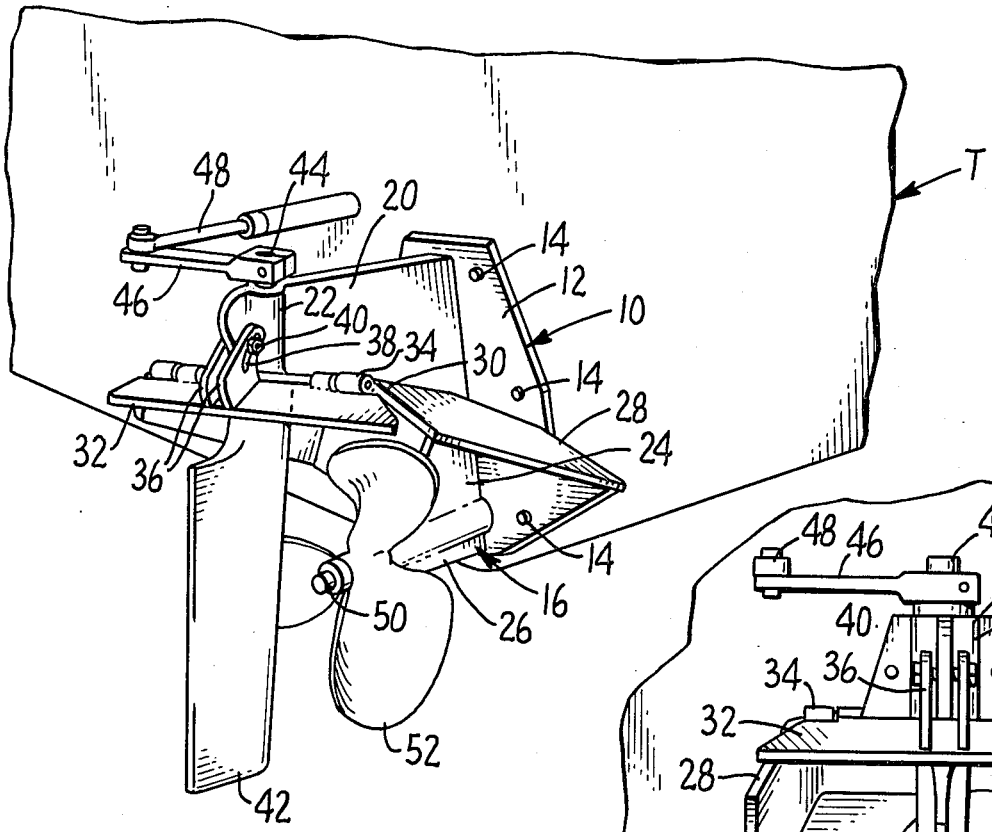
FIG. 1 is a perspective view of a single screw surface prop drive embodying the present invention.

Referring now to FIGS. 1 to 4, the assembly illustrated therein is designated in its entirety by the numeral 10 and is shown as being secured to the transom T of a boat hull H. The assembly comprises: mounting plate 12 adapted to be fixedly secured to the transom, as by bolts 14; a prop shaft support 16 fixed to the plate for juxtaposition against the transom, said support carrying an elongated prop shaft support bearing 18; a rudder support arm 20 fixed to the plate 12 and extending rearwardly therefrom, said support carrying a rudder bearing 22; an elongated generally vertically disposed web support 24 fixedly interconnecting the plate 12, bearing 18 and arm 20, said web support including an extension 26; a hood 28 fixed to and extending from the plate 12 and supported by the arm 20, said hood having a concave lower surface and terminating in a distal end 30; a spray deflector 32 hingedly secured to the distal end of the hood 28 by hinges 34; a pair of ears fixed to and extending upwardly from the defelctor 32 to either side of the arm 20, said ears having aligned arcuate slots 38 extending therethrough generally concentric with the axis of the hinges 34; and a clamp bolt 40 extending through the slots 38 and an opening in the distal end of the arm 20 to selectively lock the defelctor relative to the arm.

In the installed condition illustrated, a rudder 42 is journaled in the bearing 22 by a shaft 44. An arm 46 is clamped to the shaft 44 and a rod 48 is pivotally attached to the distal end of the arm to impart steering movement to the rudder. The rod is connected to conventional steering gear for the boat.

The bearing 18 rotatably supports a prop shaft 50 having a prop 52 mounted on its distal end and the coupling flange 53 mounted on its proximal end. A stuffing box 54 is received on the shaft internally of the hull. Although not illustrated, it should be understood that an engine is mounted within the hull and that a drive shaft from the engine is aligned with and connected to the coupling flange 53.

Figure 3:
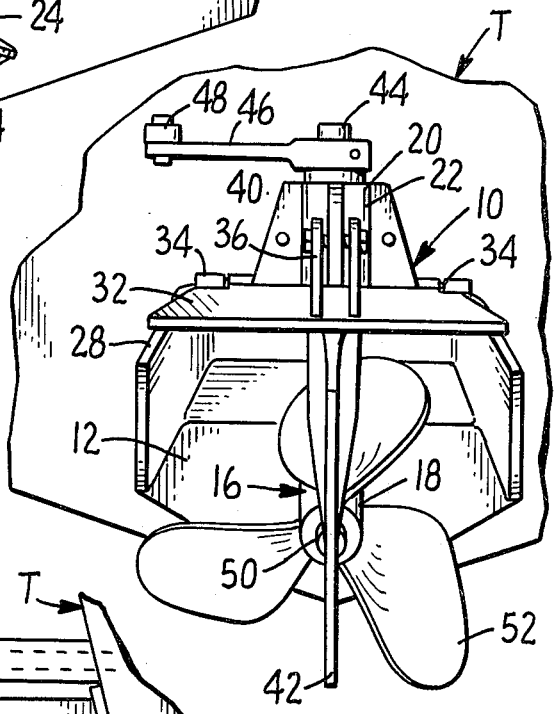
FIG. 3 is a rear elevational view of the FIG. 1 drive.
Figure 2:
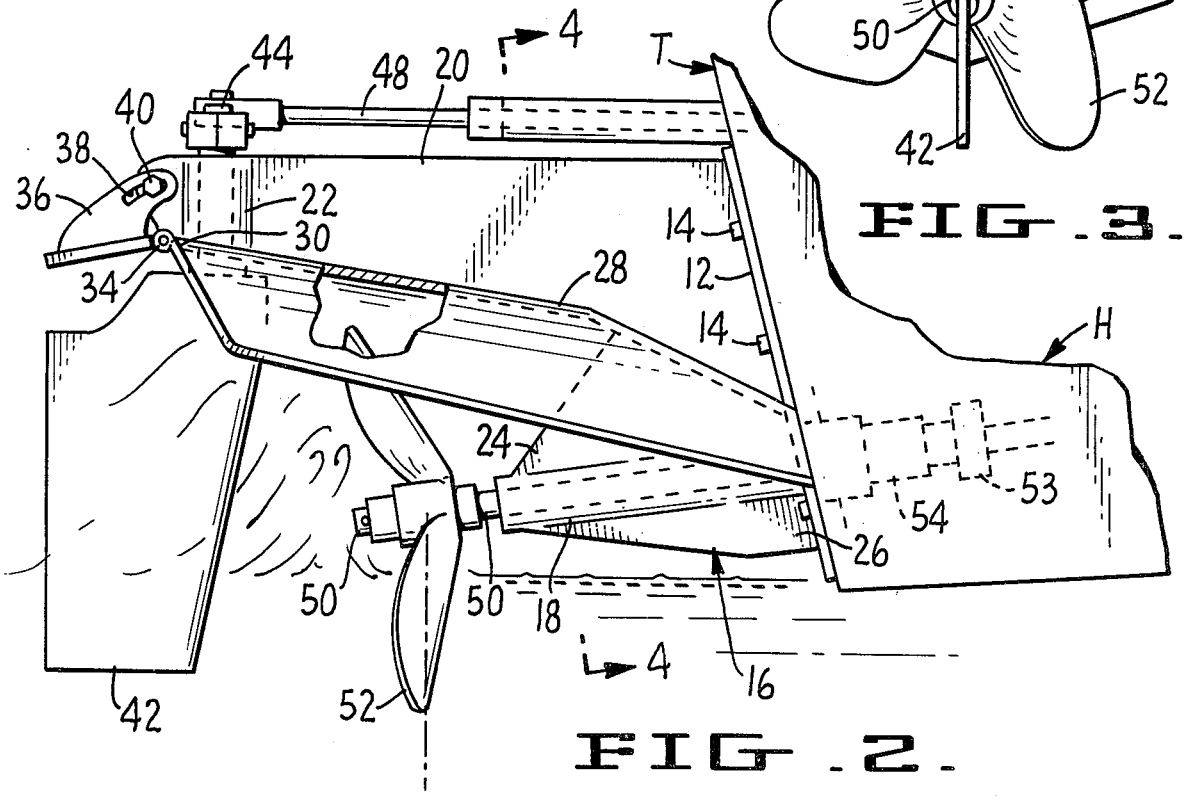
FIG. 2 is a side elevational view of the surface prop drive of FIG. 1, with the boat shown planing on the surface of a body of water, as it would appear during normal running.
Figure 4:
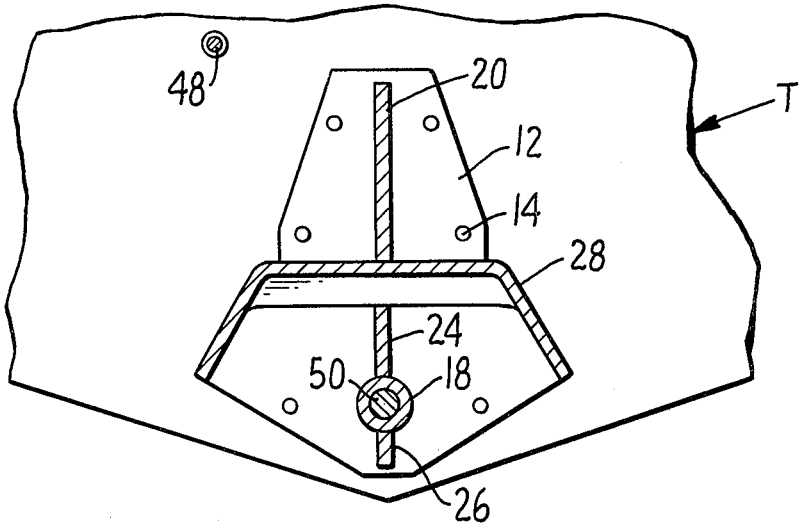
FIG. 4 is a cross-sectional view taken on the plane designated by line 4—4 of FIG. 2.

The general relative dimensions of the prop 52, hood 28 and deflector 32 may be seen from FIGS. 1, 2 and 3. The hood is proportioned to extend fully over the prop so as to define a water channel thereover when the boat is in the start-up mode operation prior to achieving a planing mode. In the start-up mode, the transom is partially submerged and water passing beneath the transom flows up under the hood and is confined thereby. Once the planing mode is achieved, the prop assumes a position as shown in FIG. 2 wherein only roughly the lower half of the prop is submerged in the water. In the latter condition, the hood 28 serves as a spray shield, together with the deflector 32. The deflector 32 is provided to suppress the large "rooster tail" which is typical with surface props. From FIG. 3, it will be seen that the deflector has a width approximately equal to the diameter of the prop. The defelctor is adjusted to achieve desired suppression of the "rooster tail", without adversely affecting performance.

From the construction of the assembly 10, it will be appreciated that it provides for the ready installation of a surface prop drive, with a minimum of hull modification. All that is necessary for the installation is to first use a template to drill the prop shaft opening in the hull and the holes necessary for the mounting bolts 14, and then to bolt the assembly to the transom. After so attaching the assembly, the stuffing box 54 is slid onto the prop shaft 50 from the interior of the hull, and the coupling flange 53 is placed on the shaft. The inboard engine is then mounted and aligned with the coupling flange coupling and connected to the coupling. The installation is completed by connecting the rudder to a through-transom steering assembly having a steering rod 48 which may be connected to the rudder arm 46. The resulting installation provides the full surface prop mounting and steering assembly. No separate outboard prop shaft supports are required.

Figure 5:
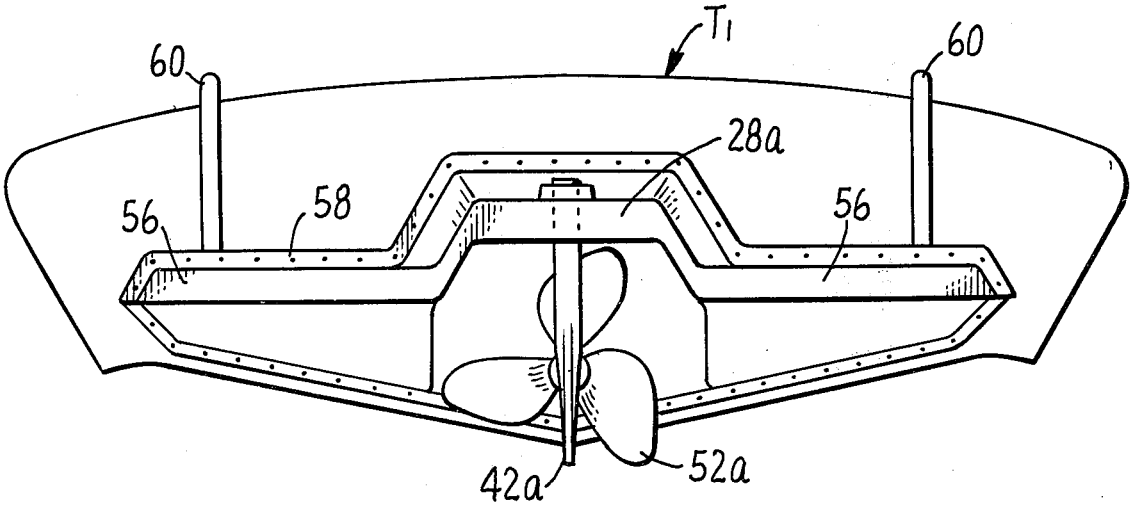
FIG. 5 is a rear elevational view of a single screw surface drive embodying the present invention, with a water skier step incorporated into the mounting assembly.

FIG. 5 illustrates a modified embodiment wherein a step for water skiers is provided integral with the hood. The modification corresponds in construction to that of FIGS. 1 to 4 with the exception that it does not employ a spray deflector and that the hood, designated 28*a*, has lateral extensions 56 which serve as a step for water skiers and also further shield the prop from exposure to skiers. In the FIG. 5 embodiment, the extensions 56 project outwardly from the hull and have a continuous flange 58 which is secured to the hull. Rails 60 are carried by and extend upwardly from the extensions 56. The transom of the hull shown in FIG. 5 is designated $T_1$. The rudder and prop are designated 42*a* and 52*a*, respectively.

Figure 6:
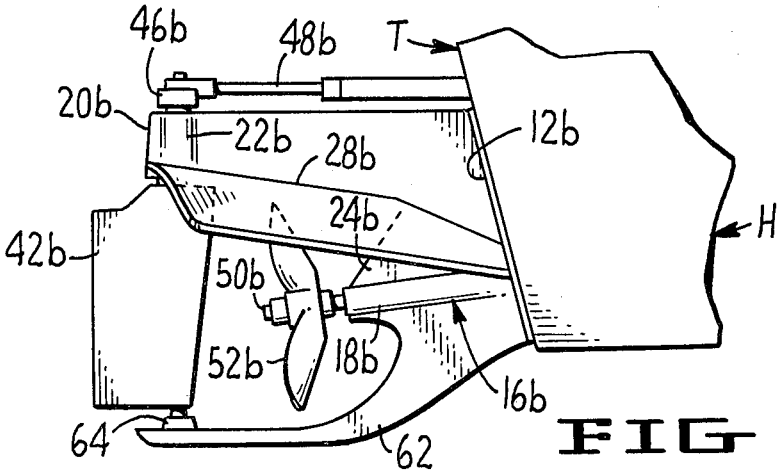
FIG. 6 is a side elevational view of a modified single screw surface drive arrangement embodying the present invention, illustrating a prop protecting skeg which may be incorporated into the mounting assembly.

The embodiment of FIG. 6 differs from that of FIGS. 1 to 4 primarily in that it is provided with a skeg 62 to shield the prop from impact by underwater obstructions and provide a lower rudder bearing 64. Another difference is that the FIG. 6 embodiment does not employ a spray deflector. The absence of a deflector in FIG. 6 is simply for the purpose of illustrating that the assembly may be used without such a deflector where the "rooster tail" spray is not of concern.

The elements of the FIG. 6 embodiment corresponding to those of the FIGS. 1 to 4 embodiment are designated by like numerals, followed by the letter "b", as follows: mounting plate 12*b*; prop shaft support 16*b*; prop shaft support bearing 18*b*; rudder support arm 20*b*; rudder bearing 22*b*; web support 24*b*; hood 28*b*; rudder 42*b*; arm 46*b*; rod 48*b*; prop shaft 50*b*; and prop 52*b*.

The skeg 62 takes the place of the web support extension 26 and is fixedly secured to the plate 12*b* and the prop shaft support bearing 18*b*. The rudder bearings 22*b* and 64 are aligned to support the rudder 42*b* for rotation about a generally vertical axis.

The skeg of the FIG. 6 embodiment will, necessarily, provide additional water resistance. Accordingly, it is anticipated that this embodiment will find primary application in installations where all-out speed is not the prime requirement.

Figure 7:
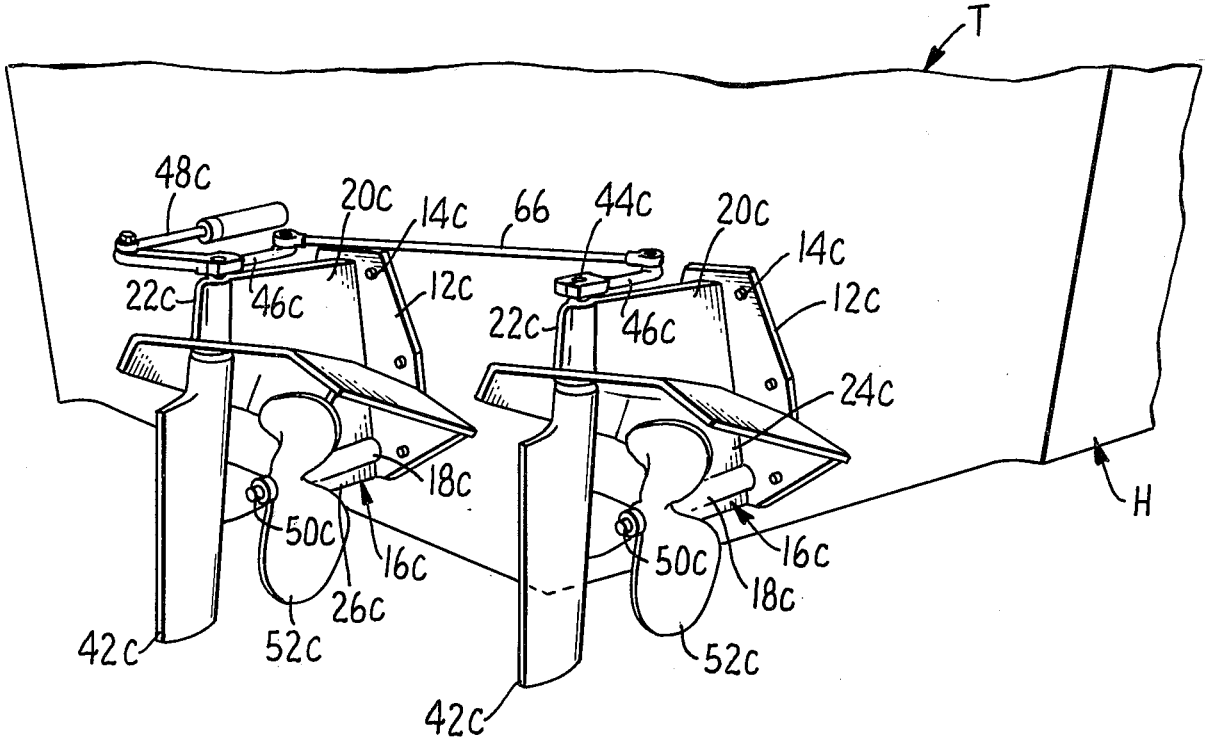
FIG. 7 is a perspective view of a twin screw surface drive arrangement embodying the present invention, wherein a pair of assemblies similar to that used for the single screw drive are employed.

The twin screw embodiment of FIG. 7 employs two assemblies corresponding substantially to the assembly of FIGS. 1 to 4, with the exception that they do not employ spray defelctors. The elements of the FIG. 7 embodiment are designated by numerals corresponding to those of the FIGS. 1 to 4 embodiment, followed by the subscript "c", as follows: mounting plates 12*c*; bolts 14*c*; prop shaft supports 16*c*; prop shaft bearings 18*c*; rudder support arms 20*c*; rudder bearings 22*c*; web supports 24*c*; web support extensions 26*c*; hoods 28*c*; rudders 42*c*; rudder shafts 44*c*; arms 46*c*; rod 48*c*; prop shafts 50*c*; and props 52*c*. A tie rod 66 connects the arms 46*c* to provide for steering movement of the rudders in unison.

Figure 8:
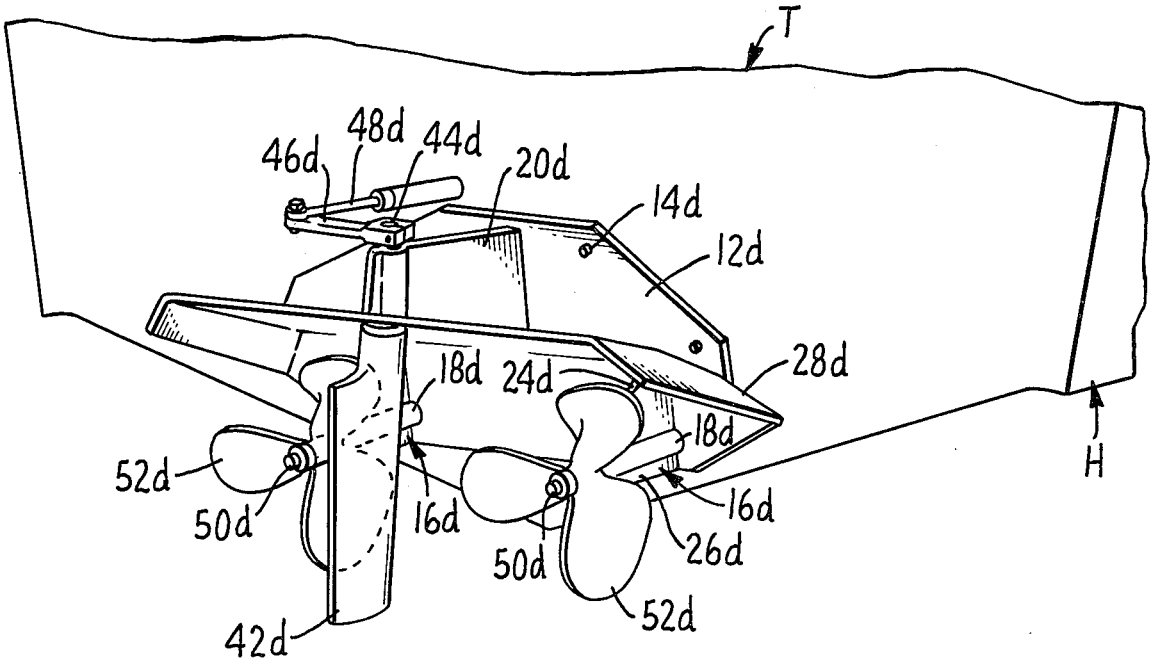
FIG. 8 is a perspective view of a twin screw surface drive embodying the present invention, wherein a single mounting assembly accommodates both screws.

The FIG. 8 embodiment differs from that of FIGS. 1 to 4 primarily in that it is designed to accommodate a pair of screws and a single rudder is mounted centrally between the screws. Another difference is that the FIG. 8 embodiment does not employ a spray deflector.

The elements of the FIG. 8 embodiment corresponding to those of the FIGS. 1 to 4 embodiment are designated by like numerals followed by the subscript "d", as follows: mounting plate 12*d*; bolts 14*d*; prop shaft supports 16*d*; prop shaft support bearings 18*d*; rudder support arm 20*d*; rudder bearing 22*d*; web supports 24*d*; web support extensions 26*d*; hood 28*d*; rudder 42*d*; rudder shaft 44*d*; rudder arm 46*d*; steering rod 48*d*; prop shafts 50*d*; and props 52*d*. From FIG. 8 it will be appreciated that the hood is of sufficient width to cover both props. The hood is of a length to provide a water flow channel above the props, similarly to that described with reference to the FIGS. 1 to 4 embodiment.

From the foregoing description, it is believed apparent that the present invention enables the attainment of the objects initially set forth herein. All of the embodiments provide a simple unitary mounting assembly whereby a surface prop drive may be readily secured to the transom of a hull, with a minimum of hull modification and shaft alignment problems.

What is claimed is:

1. A unitary assembly for mounting a surface prop on the transom of a boat hull in a position wherein, when the hull is planing on the surface of a body of water, the prop intersects the surface to the rear of the hull, said assembly comprising: a mounting plate adapted to be fixedly secured to the transom; a vertically extending prop shaft support fixed to the plate for juxtaposition against the transom upon securing the plate to the transom, said support carrying prop shaft bearing means to rotatably support a prop shaft extending through the transom, said vertically extending prop shaft support including a web-like portion extending below said prop shaft; a rudder support arm fixed to the plate and extending rearwardly therefrom above the prop shaft support, said arm carrying a rudder bearing; and, a hood carried by said plate and extending rearwardly therefrom so as to extend over and partially around the top of a prop carried by said prop shaft supported by said bearing means, said hood having a forward end intersecting the plate at a juncture above the shaft support, wherein the hood extends from the plate and has an undersurface of a generally concave configuration transverse to the longitudinal axis of said prop shaft so as to define a water channel above said prop when the hull upon which the assembly is mounted is supported in a non-planing start-up condition on the surface of a body of water.

2. An assembly according to claim 1 wherein the hood is supported on the rudder support arm.

3. An assembly according to claim 2 wherein the hood terminates in a free distal end spaced from the plate, said assembly further comprising a deflector carried by the arm and extending across said distal end.

4. An assembly according to claim 3 further including means to selectively adjust the position of the deflector relative to the prop carried by said prop shaft supported by said bearing means.

5. An assembly according to claim 1 wherein the prop shaft bearing means is elongated and extends rearwardly from the plate, the improvement wherein the prop shaft support further comprises an elongated generally vertically disposed web support fixedly interconnecting the bearing means, plate and arm.

6. An assembly according to claim 1 further comprising lateral extensions on the hood disposed to extend across the transom of a boat to which the assembly is connected to provide a water skier support step.

7. An assembly according to claim 1 further comprising: a skeg fixed to the plate and extending rearwardly therefrom so as to be disposed beneath said prop carried by said prop shaft supported by the prop shaft bearing means; and, a rudder bearing carried by said skeg in alignment with the rudder bearing carried by the arm.

8. An assembly according to claim 7 wherein the prop shaft bearing means is elongated and extends rearwardly from the plate, the improvement wherein the prop shaft support further comprises an elongated generally vertically disposed web support fixedly interconnecting the bearing means, plate, skeg and arm.

9. An assembly according to claim 1 wherein: two prop shaft supports carry a pair of bearing means to rotatably support a pair of transversely spaced prop shafts extending through the transom; and the hood is disposed so as to extend over and partially around the top of said props carried by said prop shafts supported by both of said bearing means.

10. An assembly according to claim 9 wherein the rudder bearing is disposed rearwardly of and between the bearing means.

11. In combination with a boat hull having a transom terminating in a lower edge at the bottom of the hull; a surface prop assembly for supporting a prop in intersecting relationship with the surface of a body of water upon which the hull is planing, said assembly comprising: a mounting plate fixedly secured to the transom above and adjacent the lower edge thereof; a vertically extending prop shaft support carried by the plate to rotatably support a prop shaft extending through the transom, said vertically extending prop shaft support including a web-like portion extending below said prop shaft; a hood fixed to the transom at a juncture above the prop shaft support, said hood being concave transverse to the longitudinal axis of said prop shaft and extending rearwardly from the transom in upwardly spaced relationship to the support to define a water channel above and partially around the sides of a prop carried by a shaft supported by the support, when the hull is in a non-planing start-up condition on the surface of a body of water, said hood and juncture being so spaced from the lower edge of the transom as to be elevated above the surface of a body of water upon which the hull is planing.

12. In a combination according to claim 11, the assembly wherein the hood terminates in a free distal end spaced from the plate, said assembly further comprising a deflector carried by the hood and extending across said distal end.

13. In a combination according to claim 12, the assembly further including means to selectively adjust the position of the deflector relative to said prop carried by said shaft supported by the support.

14. In a combination according to claim 11, the assembly further comprising a rudder support arm fixed to the transom and extending rearwardly therefrom above the shaft support.

* * * * *